United States Patent [19]

Zeitter et al.

[11] 4,228,898

[45] Oct. 21, 1980

[54] RECLOSABLE CARTON AND BLANK THEREFOR

[75] Inventors: Charles R. Zeitter; John F. Thomas, both of Grand Rapids, Mich.

[73] Assignee: Packaging Corporation of America, Evanston, Ill.

[21] Appl. No.: 38,656

[22] Filed: May 14, 1979

[51] Int. Cl.[3] ....., B65D 5/74; B65D 5/54

[52] U.S. Cl. ..... 206/621; 229/17 G; 229/27

[58] Field of Search ..... 229/17 G, 27; 206/621

[56] References Cited

U.S. PATENT DOCUMENTS

| | | | |
|---|---|---|---|
| 1,898,231 | 2/1933 | Weiss | 229/27 |
| 2,336,503 | 12/1943 | Ringler | 229/17 G X |
| 2,634,896 | 4/1953 | Graveno | 229/17 G |
| 2,983,421 | 5/1961 | Turpin | 229/27 X |
| 3,125,276 | 3/1964 | Zinn | 229/17 G |
| 3,189,246 | 6/1965 | Seline, Jr. | 229/17 G |
| 3,308,996 | 3/1967 | Beck | 206/621 X |
| 3,389,849 | 6/1968 | Egleston | 229/17 G |

*Primary Examiner*—Stephen P. Garbe

*Attorney, Agent, or Firm*—Neuman, Williams, Anderson & Olson

[57] ABSTRACT

A reclosable carton and blank therefor are provided wherein the interior of the carton is formed into a pair of upright continguous compartments. The carton includes a pair of wall panels and a pair of narrow side panels. The upper sections of the panels converge towards one another to effect top closing of the carton. A top closure flap is foldably connected to one of the wall panels and retains the upper sections of the wall panels in convergent relation. The upper section of each side panel includes a center segment having tapered side edges and gusset segments foldably connected to the tapered side edges and to the adjacent peripheral portions of the wall panel upper sections. When the top of the carbon is initially closed, the gusset segments of each side panel are disposed in face-to-face contacting relation and are sandwiched between corresponding portions of the wall panels. When the carton is opened the gusset segments and the center segment of a side panel are manually folded outwardly and form a pouring spout which communicates with a selected one of the interior compartments. To reclose the carton, the outwardly projecting center segment of the side panel forming the pouring spout is pushed inwardly causing the gusset segments to resume a substantial face-to-face relation and be sandwiched between corresponding portions of the wall panels.

5 Claims, 10 Drawing Figures

FIG. 1
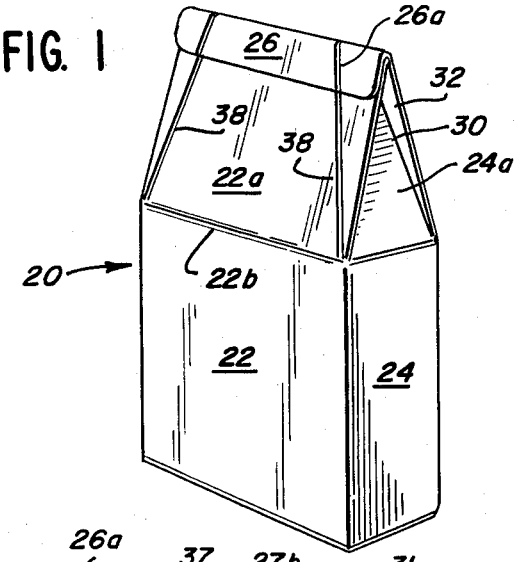
FIG. 2
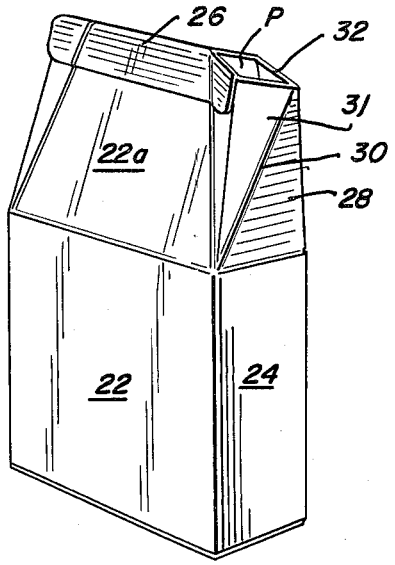
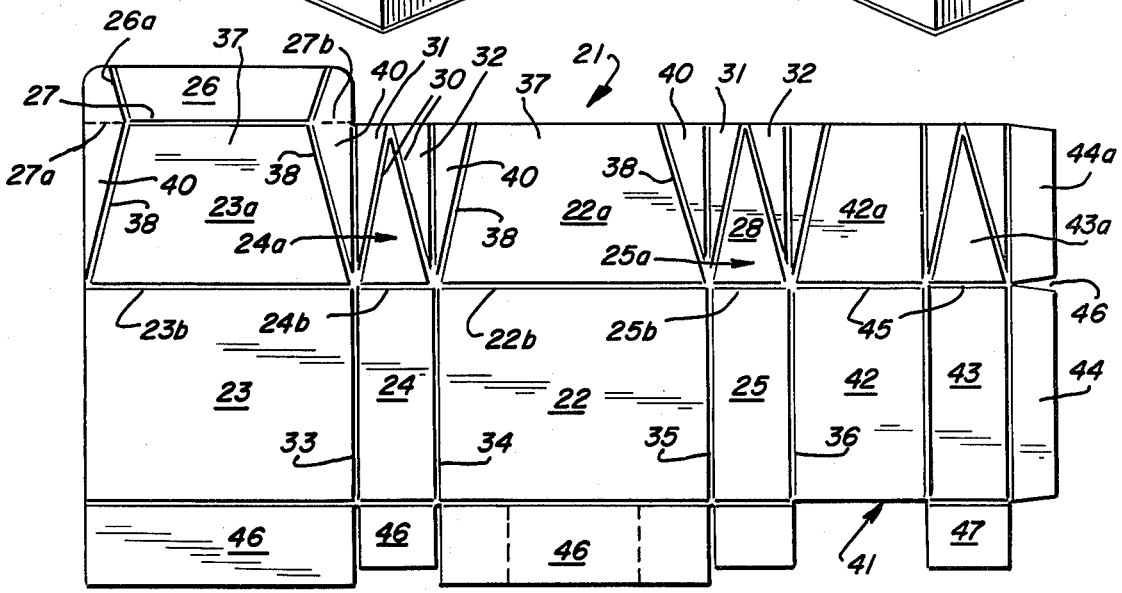
FIG. 3
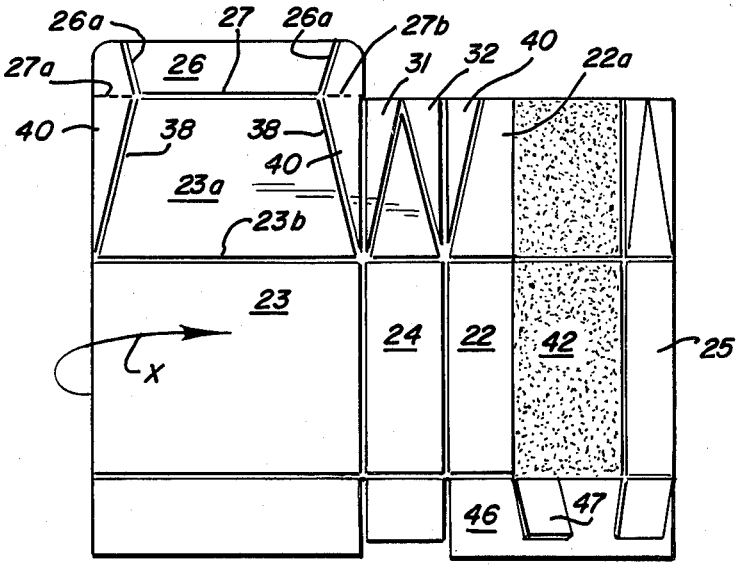
FIG. 4

FIG. 5
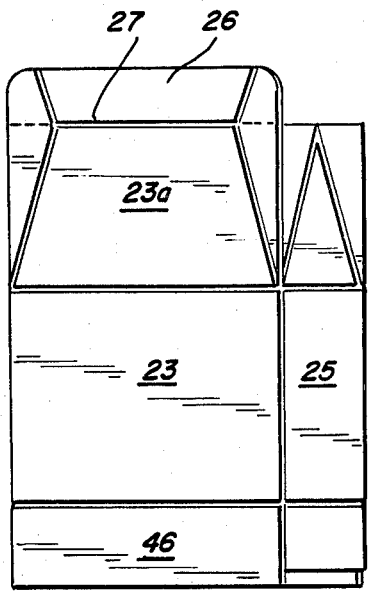
FIG. 6
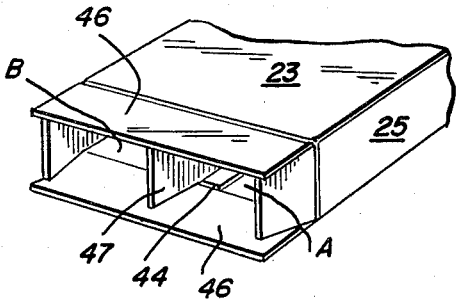
FIG. 7
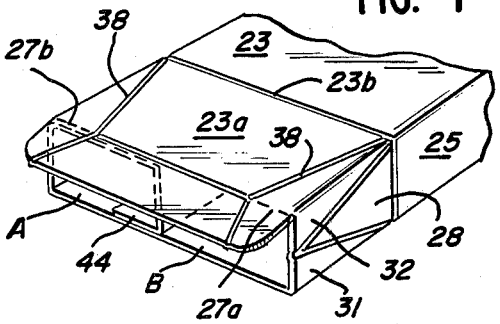
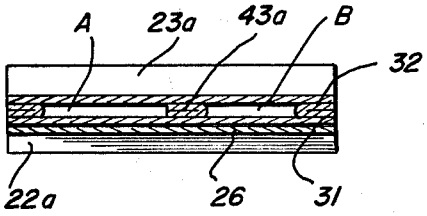
FIG. 8
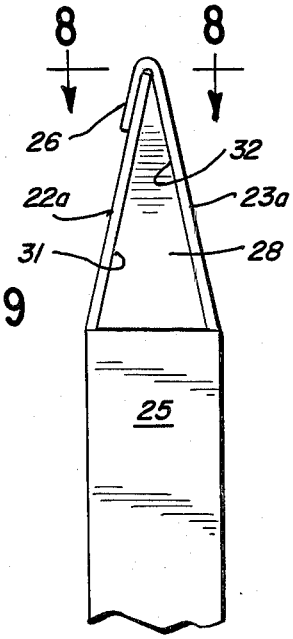
FIG. 9
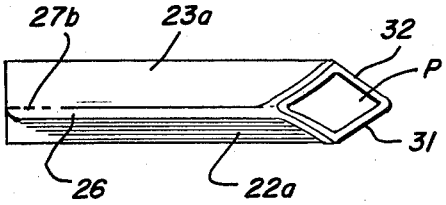
FIG. 10

RECLOSABLE CARTON AND BLANK THEREFOR

BACKGROUND OF THE INVENTION

Various reclosable cartons have heretofore been provided which include a pouring spout through which the contents of the carton are discharged. Such cartons because of inherent design characteristics are beset with one or more of the following shortcomings: (a) the carton is incapable of individually accommodating two distinct and/or separate products, one of which may be selectively discharged through a pouring spout; (b) the carton is awkward to open and close; (c) the reclosing of the carton is ineffective thereby rendering the reclosed carton susceptible to leakage; and (d) the blank from which the carton is formed requires an inordinate amount of sheet material.

SUMMARY OF THE INVENTION

Thus, it is an object of the invention to provide a reclosable carton which avoids all of the aforenoted shortcomings.

It is a further object of the invention to provide a blank which may be readily formed on conventional highspeed blanking equipment with a minimal amount of material waste.

It is a still further object of the invention to provide a simple inexpensive reclosable carton which is capable of accommodating simultaneously a plurality of different products in separate compartments and permit each product to be selectively and independently dispensed from the carton.

Further and additional objects will appear from the description, accompanying drawings and appended claims.

In accordance with one embodiment of the invention a reclosable carton is provided which is formed from a single blank of sheet material. The interior of the carton is formed into at least two upright contiguous separate compartments, each being adapted to accommodate a different product. The carton is provided with a pair of wall panels and a pair of narrow side panels. The side edge of one of the panels has foldably connected thereto a partition which has a portion thereof connected to and extending transversely of corresponding interior surface segments of the wall panels and thus provide separation between the compartments. The wall panels are provided with upper sections which converge towards one another and effect top closing of the carton. A top closure flap is connected by a foldline to the upper edge of one of the wall panels and is secured to the other wall panel so as to retain the wall panels in convergent top closing relation. Each side panel has an upper section which includes a center segment having upwardly tapered side edges terminating at one end at the upper edge of the side panel and terminating at the opposite end at the folding connections between the side panel and the wall panels. Foldably connected to each tapered side edge of the center segment is a gusset segment. When the carton is initially closed, the gusset segments of each side panel upper section are folded inwardly and are in face-to-face contacting relation and sandwiched between corresponding portions of the convergent wall panel upper sections. The end portions of the top closure flap foldline which are aligned with the inwardly folded gusset segments are weakened and are torn when the carton is initially opened so as to enable the underlying gusset segments to be manually folded outwardly and coact with the center segment to form a pouring spout. The pouring spout is adapted to be in communication with a selected one of the interior compartments of the carton.

DESCRIPTION

For a more complete understanding of the invention reference should be made to the drawings wherein:

FIg. 1 is a perspective top view of one form of the improved carton shown in an initially closed condition.

FIG. 2 is similar to FIG. 1 but showing a pouring spout formed at a selected upper corner of the carton to permit dispensing of the contents from one of the interior compartments.

FIG. 3 is a plan view of the blank for the carton of FIG. 1.

FIGS. 4 and 5 are similar to FIG. 3 but showing successive folding steps; in FIG. 5 the folded blank is in a carton-collapsed state.

FIG. 6 is a fragmentary perspective lower end view of the folded blank of FIG. 5 but showing the wall panels and side panels squared up and the bottom closure flaps in an unfolded state.

FIG. 7 is similar to FIG. 6 but showing the upper end of the folded blank with the panels thereof in squared up relation.

FIG. 8 is an enlarged sectional view taken along line 8—8 of FIG. 9.

FIG. 9 is an enlarged fragmentary side elevational view of the closed upper end of the carton of FIG. 1.

FIG. 10 is an enlarged top plan view of the carton of FIG. 2.

Referring now to the drawings and more particularly to FIGS. 1 and 2, a reclosable carton 20 is shown which is adapted to accommodate at least two products which are segregated in two contiguous independent compartments A and B (see FIGS. 6 and 7) formed within the interior of the carton. The carton is preferably formed from a single blank 21 (FIG. 3) of foldable sheet material (e.g., paperboard).

The carton 20 includes a pair of relatively wide wall panels 22, 23 having corresponding upright side edges interconnected by a pair of relatively narrow side panels 24, 25. Each wall panel has an upper section *22a, 23a*. The upper sections *22a, 23a* converge towards one another and are retained in convergent relation by a top closure flap 26 which is foldably connected to the upper edge of one wall panel 23. The flap 26 is adhesively secured to and overlies a portion of the exterior surface of the other wall panel 22. The foldline 27 which connects the flap 26 to wall panel 23 has the opposite end portions *27a, 27b* thereof weakened by perforations or the like, so that the foldline end portions may be manually torn or separated to effect initial opening of the upper corners of the carton (see FIGS. 2 and 10) in a manner to be explained more fully hereinafter.

To facilitate the wall panel upper sections assuming the convergent relation (as seen in FIGS. 1 and 2), each wall panel is provided with a transversely extending foldline *22b, 23b*.

Each of the narrow side panels 24, 25 is also provided with an upper section *24a, 25a*. Each upper section *24a, 25a* includes a center segment 28 which has tapered side edges connected by foldlines 30 to gusset segments 31, 32. The upper ends of foldines 30 intersect one another at the upper edge of the side panel. The opposite ends of the foldlines 30 terminate at the folding connections between the side panels and adjacent panels. The said opposite ends of the foldlines 30 are interconnected by transverse foldlines 24b, 25b. The wall panels and side panels are arranged in alternate side-by-side relation and adjacent panels are connected by foldlines 33, 34 and 35. A foldline 36 defines the side edge of side panel 25. The foldlines 33–36 are disposed in spaced parallel relation.

The upper sections 22a, 23a of the wall panels 22, 23 are of like construction and each includes a central portion 37 having the side edges thereof defined by convergent foldlines 38 and a pair of inverted triangular portions 40 disposed on opposite sides of the central portion 37 and connected thereto by the foldlines 38. The upper ends of the foldlines 38 formed in wall panel 23 are in spaced relation and terminate at the top closure flap foldline 27. The perforations or other weakening means formed at the opposite end portions 27a, 27b of the foldline 27 terminate at the intersections of foldlines 38 and foldline 27.

As seen in FIG. 3, it will be noted that top closure flap 26 is provided with a pair of foldlines 26a having corresponding ends thereof intersecting foldline 27 at the same locations where foldlines 38 intersect foldline 27. Thus, by reason of foldlines 26a, 38, manual opening of a corner of the carton to form a pouring spout P (see FIGS. 2, 10) is greatly facilitated.

Connected by foldline 36 to one side of side panel 25 is a partition 41 which comprises an inner panel 42 foldably connected to an intermediate panel 43 which, in turn, is foldably connected to an outer panel 44 (see FIG. 3). Each of the partition panels 42, 43 embodies an upper section 42a, 43a which is defined in part by a transverse foldline 45. Foldlines 23b, 24b, 22b, 25b and 45 are disposed in aligned end-to-end relation. The partition outer panel 44 has an upper section 44a which is defined in part by a wedge-shaped slit 46 aligned with foldline 45.

When the blank 21 is set up, the inner panel 42 is adhesively secured to the surface of wall panel 23 which forms an interior surface of compartment A. Intermediate panel 43, which has a configuration like that of the side panels 24, 25, is adapted to extend between the compartmentforming interior surfaces of the wall panels 22, 23 when the carton is squared up as seen in FIGS. 6 and 7. Outer panel 44, on the other hand, is adhesively secured to the interior compartment-forming surface of wall panel 22. It will be noted in FIG. 3 that inner, intermediate and outer panels have substantially the same height as the side and wall panels. By reason of this height uniformity there is no communication between the compartments A and B.

The bottom of carton 20 is formed by conventional closure flaps 46 which are foldably connected to the bottom edge of the wall and side panels. A bottom closure flap 47 is foldably connected to the bottom edge of intermediate panel 43 and coacts with the other bottom closure flaps to maintain proper product segregation between the two compartments A and B. If desired, the closure flap 46 which is connected to wall panel 22, may be debossed, shown in phantom lines in FIG. 3, so as to effect an improved non-sift closure.

In setting up blank 21 to form carton 20, outer panel 44 and its upper section 44a are initially folded about the foldline connection between the intermediate panel 43 and outer panel 44, so that panel 44, including its upper section 44a, overlies panel 43 and its upper section 43a, respectively. With the blank in this initial folded condition, adhesive or the like is applied to the exposed surface of panel 44 including section 44a. Subsequent to the application of the adhesive or the like to the exposed surface of panel 44 and section 44a, the partition 41 is folded about foldline 36 causing the blank to assume the condition shown in FIG. 4. When the blank is in folded condition of FIG. 4, adhesive or the like is applied to the exposed surface of inner panel 42 and its upper section 42a. When the blank assumes the folded condition of FIG. 4, the previously adhesive coated outer panel 44 and section 44a become affixed to the contacted surface of wall panel 22 and section 22a which eventually become an interior surface of the carton 20.

After the exposed surface of panel 42 and section 42a have been coated, wall panel 23 and its upper section 23a are folded as a unit about foldline 33 in the direction shown by the arrow X in FIG. 4 until the blank assumes the condition shown in FIG. 5. When the blank is in the collapsed state shown in FIG. 5, the interior (concealed) surface of panel 23 and its upper section 23a become affixed to the coated surface of the inner panel 42 and upper section 42a thereof. The blank in the FIG. 5 state is suitable for storage or for shipment to a customer for subsequent filling.

When the collapsed blank (FIG. 5) is ready to be filled with product, the blank is squared up and the bottom closure flaps 46, 47 are folded relative to one another so as to form a closed, leak-proof bottom. The top of the squared up blank is open as seen in FIG. 7, whereupon given amounts of product (e.g., either the same product or two different types of product) are loaded into compartments A and B. Once the compartments are properly loaded, the upper sections of the wall panels, side panels, and the panels of the partition are folded inwardly so as to form the gable-shaped top of the carton. The top closure flap 26, which had been precoated with an adhesive, is then folded over and secured to the exposed surface of the upper section 22a of wall panel 22.

To initially open either of the top corners of the carton requires that the gusset segments 31, 32, which are disposed at the selected corner, be grasped manually and then folded outwardly away from each other. As this manual manipulation occurs, the perforated end portion 27a, 27b of the foldline 27, which is aligned with the top edges of the gusset segments, will be torn to a sufficient extent so as to reveal the upper end of the center segment 28. As the gusset segments continue to be folded outwardly away from each other, the exposed upper end of the center segment 28 is free to move automatically outwardly whereupon a pouring spout P is formed (see FIGS. 2, 10). The pouring spout P is in communication with only one of the interior compartments A, B. Thus, selective dispensing of a particular product from the carton can be accomplished.

Once the desired amount of product has been dispensed, the upper portion of the center segment 28 is manually pushed in and due to the fight inherent in the paperboard blank material, the gusset segments 31, 32 will once again resume their foldback substantially face-to-face relation, similar to their initially closed position. When the carton is in the reclosed position, the corner is closed off by the gusset segments, thus effectively preventing product leakage.

The shape and size of the carton may vary from that illustrated without departing from the scope of the invention. Furthermore, the relative sizes of the interior compartments may be unequal and will depend upon the type and amount of product to be accommodated in each compartment.

Thus, it will be noted that the improved reclosable carton is of simple design; easily set up with conventional high-speed folding equipment; enables selected dispensing of only one product at a time; and is readily manipulated to either a dispensing or non-dispensing mode.

We claim:

1. A reclosable folding carton formed from a single blank of sheet material and having an interior formed into a pair of upright contiguous relatively isolated compartments, said carton comprising a closed bottom; substantially wide wall panels foldably connected thereto and having upper sections disposed in substantially convergent relation and forming a closed narrow elongated transversely extending top; narrow side panels foldably connected to corresponding side edges of said wall panels, each side panel being provided with an upper section including a center segment having tapered side edges and a pair of gusset segments each foldably connecting a side edge of the center segment to an adjacent side edge of the upper section of a wall panel, the upper edge portions of said pair of gusset segments initially being in face-to-face non-adhered relation and sandwiched between corresponding portions of the wall panel upper sections to initially form a closed leakproof top for said carton, the center segments of said panels being in substantially convergent relation when said carton top is closed; and elongated top closure flap connected by a foldline to the upper edge of one wall panel, said top closure flap being substantially coextensive with the upper edge of said one wall panel and secured to the upper portion of the other wall panel and concealing the upper edge portions of said other wall panel and said side panels, said foldline having at least one weakened end portion aligned with the upper edge portions of a pair of said gusset segments when the top of the carton is initially closed; and a partition foldably connected to one panel and disposed within the carton interior and having an elongated portion having a length substantially coextensive with the height of said wall panels, said portion extending between said wall panels and separating the carton interior into said contiguous isolated compartments, said partition portion having a foldable upper section of substantially the same configuration as the upper section of a side panel and being sandwiched between and sealingly secured to the convergent upper sections of said wall panels; the weakened end portion of said foldline being adapted to be torn and expose the upper edges of the gusset segments aligned therewith whereby said gusset segments are adapted to be manually folded outwardly relative to one another and coact with the adjacent center segment and form a pouring spout communicating with a selected one of said compartments.

2. The carton of claim 1 wherein the partition is foldably connected to one of said side panels.

3. The carton of claim 1 wherein the opposite end portions of the foldline are weakened and each end portion when torn enabling the resulting spout formed by the outwardly folded pair of gusset segments aligned therewith to be in communication with only a selected one of said interior compartments.

4. The carton of claim 1 wherein the upper section of each wall panel includes a central portion having substantially tapered side edges, and substantially inverted triangular portions having first corresponding edges foldably connected to the tapered side edges of the central portion and second corresponding edges foldably connected to adjacent gusset segments of said side panels; a triangular portion and the gusset segment connected thereto being in face-to-face relation when said carton top is closed.

5. A blank of foldable sheet material for use in forming a reclosable carton having an interior formed into a pair of upright contiguous relatively isolated compartments, said blank comprising a pair of wall panels and a pair of narrow side panels arranged in alternate side-by-side relation, corresponding lower edges of said panels being provided with bottom closure flaps, one wall panel having a top closure flap connected to an upper edge thereof, each side panel having an upper section including a center segment delimited in part by a pair of upwardly extending convergent foldlines, each terminating at one end at the upper edge of the side panel and at the opposite end at the folding connection between the side panel and an adjacent panel, and a pair of inverted triangular gusset segments, each having a first peripheral portion connected to the center segment by one of the convergent foldlines, a second peripheral portion foldably connected to the adjacent panel, and a third peripheral portion defining in part the upper edge of the side panel; and a partition foldably connected to the side edge of one of the panels, said partition having a portion provided with a bottom closure flap and an upper section, said portion and the upper section being of substantially the same configuration as one of said side panels, and being adapted, when said blank is set up, to be foldably connected to opposed interior surfaces of the wall panels and effect separation of the carton interior into a pair of contiguous relatively isolated upright compartments.

* * * * *